US005366840A

United States Patent [19]

Larson et al.

[11] Patent Number: 5,366,840

[45] Date of Patent: Nov. 22, 1994

[54] LIQUID DEVELOPER COMPOSITIONS

[75] Inventors: James R. Larson, Fairport; Frank J. Bonsignore; Roger N. Ciccarelli, both of Rochester; Thomas R. Pickering, Webster; Denise R. Bayley, Fairport; Jacques C. Bertrand, Ontario, all of N.Y.

[73] Assignee: Xerox Corporation, Stamford, Conn.

[21] Appl. No.: 113,115

[22] Filed: Aug. 30, 1993

[51] Int. Cl.[5] ..... G03G 9/135

[52] U.S. Cl. ..... 430/115

[58] Field of Search ..... 430/110, 115

[56] References Cited

U.S. PATENT DOCUMENTS

| | | | |
|---|---|---|---|
| 4,707,429 | 11/1987 | Trout | 430/115 |
| 4,845,003 | 7/1989 | Kiriu et al. | 430/110 |
| 5,019,477 | 5/1991 | Felder | 430/115 |
| 5,026,621 | 6/1991 | Tsubuko et al. | 430/109 |
| 5,030,535 | 7/1991 | Drappel et al. | 430/116 |
| 5,045,425 | 9/1991 | Swidler | 430/115 |
| 5,223,368 | 6/1993 | Ciccarelli et al. | 430/110 |
| 5,308,731 | 5/1994 | Larson et al. | 430/115 |

*Primary Examiner*—Roland Martin
*Attorney, Agent, or Firm*—E. O. Palazzo

[57] ABSTRACT

A liquid developer comprised of thermoplastic resin particles, an optional charge director, and a charge additive or adjuvant comprised of a component of the formulas

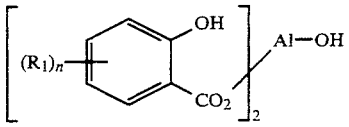

or

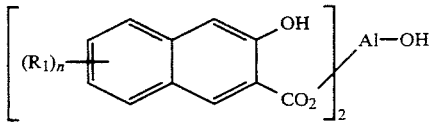

wherein $R_1$ is selected from the group consisting of hydrogen and alkyl, and n is 0 (zero), 1,2,3, or 4.

25 Claims, No Drawings

LIQUID DEVELOPER COMPOSITIONS

BACKGROUND OF THE INVENTION

This invention is generally directed to liquid developer compositions and, more specifically, the present invention relates to a liquid developer containing certain charge additives. More specifically, the present invention relates to liquid developers comprised of charge enhancing additives of the formulas

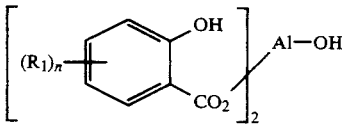

or

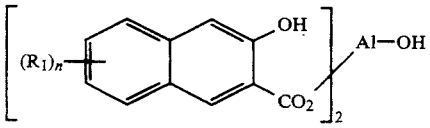

wherein $R_1$ is selected from the group consisting of hydrogen and alkyl, and n represents a number and can be 0 (zero), 1, 2, 3, or 4. A preferred charge additive is aluminum-di-tertiary-butyl salicylate or ALOHOS. The developers of the present invention can be selected for a number of known imaging systems, such as xerographic imaging and printing processes, wherein latent images are rendered visible with the liquid developers illustrated herein. Image quality, solid area coverage and resolution characteristics for developed images usually require, for example, sufficient toner particle electrophoretic mobility. The mobility for effective image development is primarily dependent on the imaging system used. The electrophoretic mobility is directly proportional to the charge on the toner particles and inversely proportional to the viscosity of the liquid developer fluid. For example, a 10 to 30 percent change in fluid viscosity caused, for instance, by a 5° to 15° C. decrease in temperature could result in a decrease in image quality, poor or unacceptable image development and undesirable background development, for example, because of a 5 percent to 23 percent decrease in electrophoretic mobility. Insufficient particle charge can also result in poor transfer of the toner to paper or other final substrates. Poor transfer can, for example, result in poor solid area coverage if insufficient toner is transferred to the final substrate and can also cause image defects such as smears and hollowed fine features. To overcome or minimize such problems, the liquid toners of the present invention were arrived at after extensive research, and which toners result in, for example, sufficient particle charge to transfer and maintain their mobility within the required range of the particular imaging system employed. Other advantages associated with the present invention include increasing the desired negative charge on the developer particles and providing a charge adjuvant, or a charge additive, that is superior to other known charge adjuvants like aluminum stearate. The aforementioned desired charge can result in improved image development and enhanced transfer.

A latent electrostatic image can be developed with toner particles dispersed in an insulating nonpolar liquid. These dispersed materials are known as liquid toners or liquid developers. A latent electrostatic image may be generated by providing a photoconductive imaging member or layer with a uniform electrostatic charge, and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems.

Typical liquid developers can comprise a thermoplastic resin and a dispersant nonpolar liquid. Generally, a suitable colorant, such as a dye or pigment, is also present in the developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 30 μm (microns) average by area size as measured with the Malvern 3600E particle sizer.

Since the formation of proper images depends primarily on the difference in the charge between the toner particles in the liquid developer and the latent electrostatic image to be developed, it is desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising thermoplastic resin, nonpolar liquid and colorant.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors illustrated may include both negative charge directors such as lecithin, oil-soluble petroleum sulfonates and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) of vinyl toluene and styrene and (iv) butadiene and acrylate. As the copolymer with polyethylene and methacrylic acid or methacrylic acid alkyl esters, NUCREL ® may be selected.

U.S. Pat. No. 5,030,535 discloses a liquid developer composition comprising a liquid vehicle, a charge control additive and toner pigmented particles. The toner particles may contain pigment particles and a resin selected from the group consisting of polyolefins, halogenated polyolefins and mixtures thereof. The liquid developers can be prepared by first dissolving the polymer resin in a liquid vehicle by heating at temperatures of from about 80° C. to about 120° C., adding pigment to the hot polymer solution and attriting the mixture, and then cooling the mixture whereby the polymer becomes insoluble in the liquid vehicle, thus forming an insoluble resin layer around the pigment particles.

U.S. Pat. No. 5,026,621 discloses a toner for electrophotography which comprises as main components a coloring component and a binder resin which is a block copolymer comprising a functional segment (A) of at least one of a fluoroalkylacryl ester block unit or a fluoroalkyl methacryl ester block unit, and a compatible segment (B) of a fluorine-free vinyl or olefin monomer block unit. The functional segment of block copolymer is oriented to the surface of the block polymer and the compatible segment thereof is oriented to be compatible with other resins, and a coloring agent is contained in the toner providing the toner with both liquid-repelling and solvent-soluble properties.

Moreover, in U.S. Pat. No. 4,707,429 there are illustrated, for example, liquid developers with an aluminum stearate charge adjuvant. Liquid developers with charge directors are also illustrated in U.S. Pat. No. 5,045,425. Also, stain elimination in consecutive colored liquid toners is illustrated in U.S. Pat. No. 5,069,995. Further, of interest with respect to liquid developers are U.S. Pat. Nos. 5,034,299; 5,066,821 and 5,028,508, the disclosures of which are totally incorporated herein by reference.

In U.S. Pat. No. 5,223,368 (D/90404), the disclosure of which is totally incorporated herein by reference, there is illustrated a dry toner with the charge additive aluminum-di-tertiary-butyl salicylate In copending patent application U.S. Ser. No. 986,316 (D/91310), the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., the developer having a melting point of at least about 25° C., wherein contacting occurs while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

Illustrated in U.S. Pat. No. 5,306,591 (D/92570)is a liquid developer comprised of a liquid component, thermoplastic resin; an ionic or zwitterionic charge director, or directors soluble in a nonpolar liquid; and a charge additive, or charge adjuvant comprised of an imine bisquinone; in U.S. Ser. No. 065,414 (D/92560) a liquid developer comprised of thermoplastic resin particles, and a charge director comprised of an ammonium AB diblock copolymer of the formula

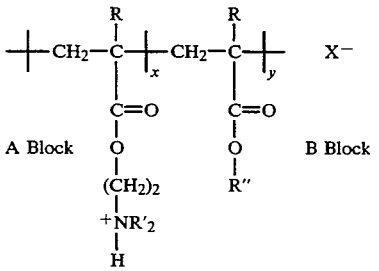

wherein $X^-$ is a conjugate base or anion of a strong acid, R is hydrogen or alkyl, R' is alkyl, R'' is an alkyl group containing from about 6 to about 20 carbon atoms, and y and x represent the number average degree of polymerization (DP) wherein the ratio of y to x is in the range of from about 10to 2 to about 100to 20; and in U.S. Pat. No. 5,308,731 (D/92571) a liquid developer comprised of a liquid, thermoplastic resin particles, a nonpolar liquid soluble charge director, and a charge adjuvant comprised of a metal hydroxycarboxylic acid. The disclosures of each of the copending patent applications are totally incorporated herein by reference.

SUMMARY OF THE INVENTION

It is an object of the present invention to provide a liquid developer with many of the advantages illustrated herein.

Another object of the present invention resides in the provision of a liquid developer capable of high particle charging.

It is a further object of the invention to provide a liquid developer wherein there are selected as charge adjuvants, or charge additives certain metal salicylates to enhance the negative charge of the developer, and provide toners such as four different toners with similar charging characteristics.

It is still a further object of the invention to provide a liquid developer wherein developed image defects, such as smearing, loss of resolution and loss of density, are eliminated or minimized.

Also, in another object of the present invention there are provided negatively charged liquid developers with certain charge adjuvants that are in embodiments superior to, for example, aluminum stearate in that they result in higher negative toner particle charge. The superior charge can result in improved image development and transfer.

Furthermore, in another object of the present invention there are provided liquid toners that enable excellent image characteristics, and which toners enhance the negative charge of resin, such a NUCREL ®, based colored toners.

These and other objects of the present invention can be accomplished in embodiments by the provision of liquid developers with certain charge adjuvants. In embodiments, the present invention is directed to liquid developers comprised of toner resin, pigment, an optional charge and director, an aluminum hydroxide charge enhancing additive, such as the aluminum salts of alkylated salicylic acid, like, for example, hydroxy bis[3,5-tertiary butyl salicylic] aluminate and which charge additive can be represented by the following formulas, or the hydrates thereof

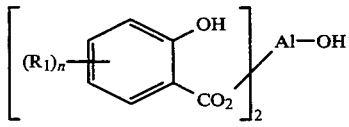

or

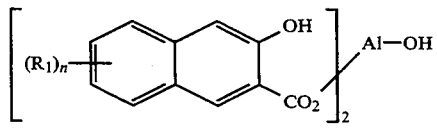

wherein $R_1$ is selected from the group consisting of hydrogen and alkyl, and n is a number such as 0 (zero), 1, 2, 3, or 4.

Embodiments of the present invention include a toner wherein $R_1$ is hydrogen, alkyl with 1 to about 25, and preferably 10 carbon atoms like methyl, ethyl, propyl, or butyl; n is 0 (zero), 1, 2, 3, or 4; and wherein $R_1$ is preferably hydrogen, isopropyl, n-butyl, isobutyl, or tert-butyl.

Examples of specific charge additives selected for the toners of the present invention, and present in various effective amounts of, for example, from about 0.1 to about 15, and preferably from about 1 to about 4 weight percent, include aluminum di-tertiary-butyl salicylate; hydroxy bis[3,5-tertiary butyl salicylic]aluminate; hydroxy bis[3,5-tertiary butyl salicylic]aluminate mono-, di-, tri- or tetrahydrates; hydroxy bis[salicylic]aluminate; hydroxy bis[monoalkyl salicylic]aluminate; hydroxy bis[dialkyl salicylic]aluminate; hydroxy bis[trialkyl salicylic]aluminate; hydroxy bis[tetraalkyl salicylic]aluminate; hydroxy bis[hydroxy naphthoic acid]aluminate; hydroxy bis[monoalkylated hydroxy naphthoic acid]aluminate; bis[dialkylated hydroxy naphthoic acid]aluminate wherein alkyl preferably contains 1 to about 6 carbon atoms; bis[trialkylated hydroxy naphthoic acid]aluminate wherein alkyl preferably contains 1 to about 6 carbon atoms; bis[tetraalkylated hydroxy naphthoic acid]aluminate wherein alkali preferably contains 1 to about 6 carbon atoms; and the like.

The aforementioned additives can be prepared as illustrated in U.S. Pat. No. 5,223,368 (D/90404), the disclosure of which is totally incorporated herein by reference, and more specifically these additives can be obtained by the reaction of two equivalents of the sodium salt of, for example, 3,5-di-tert-butyl salicylic acid with one half equivalent of a dialuminum salt, for example aluminum sulfate, $Al^2(SO^4)^3$, in an aqueous alkali solution which generates a 2:1 complex of two salicylic acid molecules about a single central aluminum atom wherein both carboxylate groups of the salicylic acid moieties are covalently bonded through the carboxylate oxygen atom to the aluminum atom. It is also believed that the hydroxy aluminum complex compounds of the present invention have a hydroxyl group (—OH) that is covalently bonded to the aluminum atom (Al), that is an Al—OH, as shown in the formulas herein and of U.S. Pat. No. 5,223,368. Also, the aromatic hydroxyl groups of the salicylic acid may be datively coordinated rather than covalently bonded to the central aluminum atom. The degree of hydration of the hydroxy aluminate complexes may vary and may depend upon how vigorously the complex is dried after isolation. It is further believed that the hydroxy aluminate complexes when formed with the processes as illustrated herein in embodiments can form mixtures. The water of hydration is believed to be strongly associated with the aluminum atom and is not easily removed upon heating under vacuum for 24 hours at 100° C. and above. Further, although not being desired to be limited to theory, it is believed in embodiments that the hydroxy aluminate complexes may derive negative charge directing ability from both the covalently bound hydroxyl group and the water of hydration. These structural features may serve to stabilize the complex and also serve as a reservoir of readily exchangeable protons. Therefore, the charge additives of the present invention in embodiments can be prepared by the reaction of at least two molar equivalents of the sodium or alkali salt of a salicylic acid derivative wherein $R_1$ is hydrogen or alkyl with, for example, from 1 to about 25 carbon atoms as illustrated herein, and wherein n represents the number of $R_1$ groups, and can be zero, 1, 2, 3, or 4 with a one molar aluminum equivalent of an aluminum containing salt, for example using a dialuminum salt, such as aluminum sulfate $Al_2(SO_4)_3$, about one half molar equivalent. The aluminum salt reactant may be a hydrated compound, for example $Al_2(SO_4)_3.XH_2O$ and wherein X represents the number of water components such as 0 to about 25. The reaction sequence is preferably accomplished by first converting an alpha hydroxy carboxylic acid compound, that is a salicylic acid derivative, into the corresponding alkali metal salt, for example sodium, in an aqueous alkali solution. The aqueous alkali solution containing the alkali salt of the alpha hydroxy carboxylate is then added to an acidic aqueous solution containing the aluminum containing salt reactant with rapid stirring. This inverse addition ensures that the complexing aluminum species is initially present in excess relative to the concentration of the added sodium salt. The inverse addition also avoids or minimizes tris- complex formation, $[RCO_2]_3Al$, wherein R is alkyl, that is a product having three carboxylate containing ligands bonded to the aluminum atom and no hydroxy-aluminum bond. Cooling the reaction mixture to room temperature produces a precipitate that may be collected by filtration. The crude product may be purified further by washing with, for example, water or other suitable solvents until the acidity of the wash water is nearly constant, for example a pH of about 5.5. The product is preferably dried to a constant weight in a vacuum drying oven. The reaction can provide a 2:1 complex of two salicylic acid molecules arranged about a single central aluminum atom wherein both carboxylate groups of the salicylic acid moieties are covalently bonded through the carboxylate oxygen atom to the aluminum atom. It is also believed that the hydroxy aluminum complex compounds prepared in this manner have a hydroxyl group (—OH) that is covalently bonded to the aluminum atom.

Embodiments of the present invention include a liquid developer comprised of thermoplastic resin particles; a charge director; and the aforementioned charge additives; a liquid developer comprised of a liquid component, thermoplastic resin; an ionic or zwitterionic charge director or directors soluble in a nonpolar liquid; the aforementioned aluminum charge additives; and a liquid electrostatographic developer comprised of (A) a liquid having viscosity of from about 0.5 to about 20 centipoise and resistivity equal to and preferably greater than $5\times10^9$; (B) thermoplastic resin particles with an average volume particle diameter of from about 0.1 to about 30 microns, and preferably from 1 to about 12 microns; (C) a nonpolar liquid soluble ionic or zwitterionic charge director compound; and (D) the aluminum complex charge additive of the formula illustrated herein.

Examples of liquid carriers or components selected for the developers of the present invention include a liquid with an effective viscosity of, for example, from about 0.5 to about 500 centipoise, and preferably from about 1 to about 20 centipoise, and a resistivity equal to or greater than $5\times10^9$ ohm/cm, such as $5\times1013$ Preferably, the liquid selected is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are generally known and should have an electrical volume resistivity in excess of 109 ohm-centimeters and a dielectric constant below 3.0 in embodiments of the present invention. Moreover, the vapor pressure at 25° C. should be less than 10 Torr in embodiments.

While the ISOPAR® series liquids can be the preferred nonpolar liquids for use as dispersants in the liquid developers of the present invention, the essential characteristics of viscosity and resistivity may be satisfied with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 90 to about 99.9 percent, and preferably from about 95 to about 99 percent by weight of the total developer dispersion, however, other effective amounts may be selected. The total solids content of the developer in embodiments is, for example, 0.1 to 10 percent by weight, preferably 0.3 to 3 percent, and more preferably, 0.5 to 2.0 percent by weight.

Typical suitable thermoplastic toner resins can be selected for the liquid developers of the present invention in effective amounts, for example, in the range of about 99 percent to about 40 percent, and preferably 95 percent to 70 percent of developer solids comprised of thermoplastic resin, pigment, charge aluminum additive, and in embodiments other components that may comprise the toner. Generally, developer solids include the thermoplastic resin, optional pigment and charge control agent. Examples of resins include ethylene vinyl acetate (EVA) copolymers (ELVAX® resins, E. I. DuPont de Nemours and Company, Wilmington, Del.); copolymers of ethylene and an $\alpha$-$\beta$-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E. I. DuPont de Nemours and Company); or blends thereof. Preferred copolymers in embodiments include the copolymers of ethylene and an $\alpha$-$\beta$-ethylenically unsaturated acid of either acrylic acid or methacrylic acid. In preferred embodiments, NUCREL® resins available from E. I. DuPont de Nemours and Company like NUCREL® 599, NUCREL® 699, or NUCREL® 960 are selected as the thermoplastic resin.

The liquid developer of the present invention may optionally contain, and preferably does contain in embodiments a colorant dispersed in the resin particles. Colorants, such as pigments or dyes and mixtures thereof, are preferably present to render the latent image visible.

The colorant may be present in the toner in an effective amount of, for example, from about 0.1 to about 60 percent, and preferably from about 1 to about 30, and in embodiments 10 percent by weight based on the total weight of solids contained in the developer. The amount of colorant used may vary depending on the use of the developer. Examples of pigments which may be selected include carbon blacks available from, for example, Cabot Corporation, FANAL PINK™, PV FAST BLUE™, those pigments as illustrated in U.S. Pat. No. 5,223,368 (D/90404), the disclosure of which is totally incorporated herein by reference; other known pigments; and the following.

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR® YELLOW YT-858-D | Heubach | Yellow 74 |
| Hansa Yellow X | Hoechst | Yellow 75 |
| NOVAPERM® YELLOW HR | Hoechst | Yellow 83 |
| L75-2337 Yellow | Sun Chemical | Yellow 83 |
| CROMOPHTHAL® YELLOW 3G | Ciba-Geigy | Yellow 93 |
| CROMOPHTHAL® YELLOW GR | Ciba-Geigy | Yellow 95 |
| NOVAPERM® YELLOW FGL | Hoechst | Yellow 97 |
| Hansa Brilliant Yellow 10GX | Hoechst | Yellow 98 |
| LUMOGEN® LIGHT YELLOW | BASF | Yellow 110 |
| Permanent Yellow G3R-01 | Hoechst | Yellow 114 |
| CROMOPHTHAL® YELLOW 8G | Ciba-Geigy | Yellow 128 |
| IRGAZINE® YELLOW 5GT | Ciba-Geigy | Yellow 129 |
| HOSTAPERM® YELLOW H4G | Hoechst | Yellow 151 |
| HOSTAPERM® YELLOW H3G | Hoechst | Yellow 154 |
| HOSTAPERM® ORANGE GR | Hoechst | Orange 43 |
| PALIOGEN® ORANGE | BASF | Orange 51 |
| IRGALITE® RUBINE 4BL | Ciba-Geigy | Red 57:1 |
| QUINDO® MAGENTA | Mobay | Red 122 |
| INDOFAST® | Mobay | Red 123 |

-continued

| PIGMENT BRAND NAME | MANUFACTURER | COLOR |
|---|---|---|
| BRILLIANT SCARLET HOSTAPERM ® | Hoechst | Red 168 |
| SCARLET GO Permanent Rubine F6B | Hoechst | Red 184 |
| MONASATRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue 3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, CI 77266 |
| UHLICH ® BK 8200 | Paul Uhlich | Black |

Suitable nonpolar liquid soluble ionic or zwitterionic charge director compounds, which are selected in various effective amounts, such as for example from about 0.25 to about 1,500 milligrams/gram, and preferably 2.5 to 400 milligrams/gram based on the amount of developer solids comprised of resin, pigment, and charge adjuvant, include anionic glyceride, such as EMPHOS D70-30C TM and EMPHOS F27-85 TM, two products available from Witco Corporation, New York, N.Y., which are sodium salts of phosphated mono and diglycerides with unsaturated and saturated acid substituents, respectively, lecithin, BASIC BARIUM PETRONATE®, NEUTRAL BARIUM PETRONATE®, CALCIUM PETRONATE®, NEUTRAL CALCIUM PETRONATE®, oil soluble petroleum sulfonates, Witco Corporation, New York, N.Y.; and metallic soaps such as barium, calcium, lead, and zinc stearates; cobalt, manganese, lead, and zinc linoleates, calcium and cobalt octoates, quaternary ammonium block copolymers as illustrated, for example, in U.S. Pat. No. 5,035,972, the disclosure of which is totally incorporated herein by reference, other known charge directors, and the like.

The charge on the toner particles may be measured with respect to particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is important for image development and background cleaning. Toner particle mobility can be measured using the electroacoustics effect, the application of an electric field, and the measurement of sound described, for example, in U.S. Pat. No. 4,497,208, the disclosure of which is totally incorporated herein by reference. This technique is particularly useful for nonaqueous dispersions because the measurements can be accomplished at high volume loadings, for example greater than 1 weight percent. Measurements rendered by this technique have been shown to correlate with image quality, that is for example high measured mobilities have been shown to result in improved image density, higher image resolution and superior transfer efficiency. Residual conductivity, that is the conductivity from the charge director, can be measured with a low field device as described herein.

To increase the toner particle charge and, accordingly, increase the mobility and transfer latitude of the toner particles, charge adjuvants can be added to the toner particles. For example, adjuvants, such as metallic soaps like aluminum or magnesium stearate or octoate, fine particle size oxides, such as oxides of silica, alumina, titania, and the like, paratoluene sulfonic acid, and polyphosphoric acid, may be added. Negative charge adjuvants increase the negative charge of the toner particles, while the positive charge adjuvants increase the positive charge of the toner particles. With the invention of the present application, these types of adjuvants can assist in enabling improved toner charging characteristics, namely, an increase in particle charge that results in improved electrophoretic mobility for improved image development and transfer to allow superior image quality with improved solid area coverage and resolution in embodiments. The adjuvants can be added to the toner particles in an amount of from about 0.1 percent to about 15 percent of the total developer solids and preferably from about 1 percent to about 5 percent of the total weight of solids contained in the developer.

The liquid electrostatic developer of the present invention can be prepared by a variety of processes such as, for example, mixing in a nonpolar liquid the thermoplastic resin, charging additive, and optional colorant and adjuvant in a manner that the resulting mixture contains, for example, about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to about 20 percent by weight; cooling the dispersion to about 10° C. to about 50° C.; adding the aluminum charge director compound to the dispersion; and diluting the dispersion.

In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer manufactured by Charles Ross and Son, Hauppauge, N.Y., or a two roll heated mill, which usually requires no particulate media. Useful particulate media include materials like a spherical cylinder of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 15 to about 50 percent solids. This mixture is then subjected to elevated temperatures during the initial mixing procedure to plasticize and soften the resin. The mixture is sufficiently heated to provide a uniform dispersion of all the solid materials of, for example, colorant, charge director, adjuvant and resin. However, the temperature at which this step is undertaken should not be so high as to degrade the nonpolar liquid or decompose the resin or colorant if present. Accordingly, the mixture in embodiments is heated to a temperature of from about 70° C. to about 130° C., and preferably from about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added should be sufficient in embodiments to decrease the total solids concentration of the dispersion to about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid like water, glycols, such as ethylene glycol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 6 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778; 4,783,389, the disclosures of which are totally incorporated herein by reference.

As illustrated herein, the developers or inks of the present invention can be selected for imaging and printing methods wherein, for example, a latent image is formed on a photoconductive imaging member, reference for example selenium, selenium alloys, those of U.S. Pat. No. 4,265,990, the disclosure of which is totally incorporated herein by reference, and the like; followed by development with the toner of the present invention by, for example, immersion of the imaging member in the liquid toner; transfer to a suitable substrate like paper; and fixing by heating.

Embodiments of the invention will be illustrated in the following nonlimiting Examples, it being understood that these Examples are intended to be illustrative only and that the invention is not intended to be limited to the materials, conditions, process parameters and the like recited. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to provide an ESA signal corresponding to a zeta potential of −26 millivolts for a 10 percent (v/v) suspension of LUDOX TM (DuPont). The system was then set up for nonaqueous measurements. The toner particle mobility can be dependent on a number of factors, including primarily particle charge and particle size. The ESA system also calculates the zeta potential which is a directly proportional to toner charge and is independent of particle size. Particle size was measured by Horiba CAPA-500 centrifugal automatic particle analyzer manufactured by Horiba Instruments, Inc., Irvine, Calif.

Specific embodiments of the invention will now be described in detail. These Examples are intended to be illustrative, and the invention is not limited to the materials, conditions, or process parameters set forth in these embodiments. All parts and percentages are by weight unless otherwise indicated.

EXAMPLE I

Synthesis of Hydroxy Bis[3,5-Tertiary Butyl Salicyclic-]Aluminate Monohydrate at Elevated Temperature:

To a solution of 12 grams (0.3 mole) of NaOH in 500 milliliters of water were added 50 grams (0.2 mole) of di-tert-butyl salicylic acid. The resulting mixture was heated to 60° C. to dissolve the acid. A second solution was prepared from dissolving 33.37 grams (0.05 mole) of aluminum sulfate, $Al_2(SO_4)_3.18H_2O$, into 200 milliliters of water with heating to 60° C. The former solution containing the sodium salicylate salt was added rapidly dropwise into the latter aluminum sulfate salt solution with stirring. When the addition was complete, the reaction mixture was stirred an additional 5 to 10 minutes at 60° C. and then cooled to room temperature, about 25° C. The mixture was then filtered and the collected solid product was washed with water until the acidity of the used wash water was about 5.5. The product was dried for 16 hours in a vacuum oven at 110° C. to afford 52 grams (0.096 mole, 96 percent theory) of a white powder of the above monohydrate, melting point of >300° C. When a sample of the product obtained was analyzed for water of hydration by Karl-Fischer titration after drying for an additional 24 hours at 100° C. in a vacuum, the sample contained 2.1 percent weight of water. The theoretical value calculated for a monohydrate is 3.2 percent weight of water.

Infrared spectra of the above product hydroxy bis[3,5-tertiary butyl salicylic]aluminate monohydrate indicated the absence of peaks characteristic of the starting material di-tert-butyl salicylic acid and indicated the presence of an Al—OH band characteristic at 3,660 $cm^{-1}$ and peaks characteristic of water of hydration.

NMR analysis for the hydroxy aluminate complex was obtained for carbon, hydrogen and aluminum nuclei and were all consistent with the above prepared monohydrate.

| | |
|---|---|
| Elemental Analysis Calculated for | |
| $C_{30}H_{41}O_7Al$: | C, 66.25; H, 7.62: Al, 5.52. |
| Calculated for | |
| $C_{30}H_{41}O_7Al.1H_2O$: | C, 64.13; H, 7.74; Al, 4.81. |

-continued

| | |
|---|---|
| Found: | C, 64.26; H, 8.11; Al, 4.67. |

EXAMPLE II

Synthesis of Hydroxy Bis[3,5-Tertiary Butyl Salicylic-]Aluminate Hydrate at Room Temperature:

The procedure of Example I was repeated with the exception that the mixing of the two solutions and subsequent stirring was accomplished at room temperature, about 25° C. The product was isolated and dried as in Example I, and identified as the above hydroxy aluminum complex hydrate by IR.

Control 1

Twenty-five (25) grams of NUCREL 599® (a copolymer of ethylene and methacrylic acid with a melt index at 190° C. of 500, available from E. I. DuPont de Nemours & Company, Wilmington, Del.), 6.3 grams of the magenta pigment (FANAL PINK TM) and 170 grams of NORPAR 15200, carbon chain average 15 (Exxon Corporation), were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 70° to 104° C. for 2 hours, cooled by running water through the attritor jacket to 23° C., and ground in the attritor for an additional 4 hours. Additional NORPAR 15® was added and the mixture was separated by the use of a metal grate from the steel balls. To 538 grams of the mixture (2.8 percent solids) were added 953 grams of NORPAR 15® and 0.9 gram of BASIC BARIUM PETRONATE (Witco Chemical Corporation, New York, N.Y.). The average by area particle diameter was 2.1 microns measured with a Horiba Capa 500 particle size analyzer. The mobility of the toner was measured and the image quality was assessed using a Savin 870 copier. The results are presented hereinafter

CONTROL 2

Twenty-five (25) grams of NUCREL 599® (a copolymer of ethylene and methacrylic acid with a melt index at 190° C. of 500 available from E. I. DuPont de Nemours & Company, Wilmington, Del.), 6.3 grams of the magenta pigment (FANAL PINK TM), 0.63 gram of aluminum stearate, WITCO 22 TM, (Witco Chemical Corporation, New York, N.Y.), and 170 grams of NORPAR 15® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56 to 100° C. for 2 hours, cooled by running water through the attritor jacket to 22° C., and ground in the attritor for an additional 4 hours. Additional NORPAR 15®, about 50 grams, was added and the mixture was separated from the steel balls. To 487 grams of the mixture (3.1 percent solids) were added 1,004 grams of NORPAR 15®, and 0.9 gram of BASIC BARIUM PETRONATE TM (Witco Chemical Corporation, New York, N.Y.). The average by area particle diameter was 1.8 microns measured with a Horiba Capa 500 particle size analyzer. The mobility of the toner was measured and the image quality was assessed with a Savin 870 copier. The results are presented hereinafter.

EXAMPLE III

Twenty-five (25) grams of NUCREL 599 ® (a copolymer of ethylene and methacrylic acid with a melt index at 190° C. of 500, available from E. I. DuPont de Nemours & Company, Wilmington, Del.), 6.3 grams of the magenta pigment (FANAL PINK TM), 0.63 gram of the aluminum complex charge additive of Example I, and 170 grams of NORPAR 15® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° to 106° C. for 2 hours, cooled by running water through the attritor jacket to 23° C., and ground in the attritor for an additional 4 hours. Additional NORPAR 15®, about 50 grams, was added and the mixture was separated from the steel balls. To 588 grams of the mixture (2.55 percent solids) were added 927.8 grams of NORPAR 15® and 0.9 gram of BASIC BARIUM PETRONATE TM (Witco Chemical Corporation, New York, N.Y.). The toner average by area particle diameter was 1.6 microns measured with a Horiba Capa 500 particle size analyzer. The mobility of the resulting liquid toner was measured and the image quality was assessed using a Savin 870 copier. The results are presented hereinafter.

| EXAMPLE | ADDITIVE (%) | MOBILITY ($10^{-10}M^2/Vs$) | SOLID AREA DENSITY | TRANSFER EFFICIENCY |
|---|---|---|---|---|
| Control 1 | None | −1.05 | 0.61 | 52 |
| Control 2 | Aluminum Stearate | −1.51 | .99 | 67 |
| Example | Example I | −1.99 | 0.99 | 73 |

Control 3

Twenty-eight (28) grams of NUCREL 599® (a copolymer of ethylene and methacrylic acid with a melt index at 190° C. of 500, available from E. I. DuPont de Nemours & Company, Wilmington, Del.), 7.0 grams of the cyan pigment (PV FAST BLUE TM), and 200 grams of NORPAR 15®, carbon chain average 15 (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 53° to 103° C. for 2 hours, cooled by running water through the attritor jacket to 17° C., and ground in the attritor for an additional 4 hours. Additional NORPAR 15®, about 50 grams, was added and the mixture was separated from the steel balls. A portion of this mixture was diluted with NORPAR 15® to enable 1,500 grams of a 1.0 percent solids dispersion. To this was added 0.9 gram of BASIC BARIUM PETRONATE® (Witco Chemical Corporation, New York, N.Y.). The toner average by area particle diameter was 1.94 microns measured with a Horiba Capa 500 particle size analyzer. The mobility of the toner was measured and the image quality was assessed using a Savin 870 copier. The results follow.

Control 4

Twenty-seven (27) grams of NUCREL 599® (a copolymer of ethylene and methacrylic acid with a melt index at 190° C. of 500, available from E. I. DuPont de Nemours & Company, Wilmington, Del.), 7.0 grams of the cyan pigment (PV FAST BLUE TM), 0.17 grams of aluminum stearate, WITCO 22 TM, (Witco Chemical Corporation, New York, N.Y.), and 200 grams of NORPAR 15® (Exxon Corporation) were added to a Union Process O1 attritor (Union Process Company, Akron, Ohio) charged with 0.1857 inch (4.76 millimeter) diameter carbon steel balls. The mixture was milled in the attritor which was heated with running steam through the attritor jacket at 58° to 100° C. for 2 hours, cooled by running water through the attritor jacket to ambient temperature, and ground in the attritor for an additional 4 hours. Additional NORPAR 15®, about 50 grams, was added and the mixture was separated from the steel balls. A portion of this mixture was diluted with NORPAR 15® to enable 1,500 grams of a 1.0 percent solids dispersion. To this was added 0.9 gram of BASIC BARIUM PETRONATE TM (Witco Chemical Corporation, New York, N.Y.). The toner average by area particle diameter was 2.24 microns measured with a Horiba Capa 500 particle size analyzer. The mobility of the toner was measured and the image quality was assessed using a Savin 870 copier. The results follow.

Control 5

Twenty-seven (27) grams of NUCREL 599® (a copolymer of ethylene and methacrylic acid with a melt index at 190° C. of 500, available from E. I. DuPont de Nemours & Company, Wilmington, Del.), 7.0 grams of the cyan pigment (PV FAST BLUE TM), 0.70 gram of aluminum stearate, WITCO 22 TM, (Witco Chemical Corporation, New York, N.Y.), and 200 grams of NORPAR 15® (Exxon Corporation) were added to a Union Process O1 attritor (Union Process Company, Akron, Ohio) charged with 0.1857 inch (4.76 millimeter) diameter carbon steel balls. The mixture was milled in the attritor which was heated with running steam through the attritor jacket at 58° to 100° C. for 2 hours, cooled by running water through the attritor jacket to ambient temperature, and ground in the attritor for an additional 4 hours. Additional NORPAR 15®, about 50 grams, was added and the mixture was separated from the steel balls. A portion of this mixture was diluted with NORPAR 15® to enable 1,500 grams of a 1.0 percent solids dispersion. To this was added 0.9 gram of BASIC BARIUM PETRONATE TM (Witco Chemical Corporation, New York, N.Y.). The toner average by area particle diameter was 1.99 microns measured with a Horiba Capa 500 particle size analyzer. The mobility of the toner was measured and the image quality was assessed using a Savin 870 copier. The results follow.

EXAMPLE IV

Twenty-five (25.0) grams of NUCREL 599® (a copolymer of ethylene and methacrylic acid with a melt index at 190° C. of 500, available from E. I. DuPont de Nemours & Company, Wilmington, Del.), 6.3 grams of the cyan pigment (PV FAST BLUE TM), 0.16 gram of the aluminum complex charge additive of Example I, and 170 grams of NORPAR 15® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 55° to 106° C. for 2 hours, cooled by running water through the attritor jacket to ambient temperature, and ground in the attritor for an additional 4 hours. Additional NORPAR 15®, about 50 grams, was added and the mixture was separated from the steel balls. A portion of this mixture was diluted with NORPAR 15® to enable 1,500 grams of a 1.0 percent solids dispersion. To this was added 0.9 gram of BASIC BARIUM PETRONATE TM (Witco Chemical Corporation, New York, N.Y.). The toner average by area particle diameter was 2.01 microns as measured with a Horiba Capa 500 particle size analyzer. The mobility of the toner was measured and the image quality was assessed using a Savin 870 copier. The results are presented below.

EXAMPLE V

Twenty-five (25.0) grams of NUCREL 599® (a copolymer of ethylene and methacrylic acid with a melt index at 190° C. of 500, available from E. I. DuPont de Nemours & Company, Wilmington, Del.), 6.3 grams of the cyan pigment (PV FAST BLUE TM), 0.63 gram of the aluminum complex of Example I, and 170 grams of NORPAR 15® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 54° to 100° C. for 2 hours, cooled by running water through the attritor jacket to ambient temperature, and ground in the attritor for an additional 4 hours. Additional NORPAR 15®, about 50 grams, was added and the mixture was separated from the steel balls. A portion of this mixture was diluted with NORPAR 15® to enable 1,500 grams of a 1.0 percent solids dispersion. To this was added 0.9 gram of BASIC BARIUM PETRONATE TM (Witco Chemical Corporation, New York, N.Y.). The toner average by area particle diameter was 1.84 microns as measured with a Horiba Capa 500 particle size analyzer. The mobility of the toner was measured and the image quality was assessed in a Savin 870 copier. The results follow.

| Example | Additive (%) | Mobility $10^{-10}m^2/Vs$ | Cond. ps/cm | Solid Area Density | Transfer Efficiency | Resolution (lp/mm) |
|---|---|---|---|---|---|---|
| Control 3 | None | −0.6 | 7 | 0.6 | 38 | 7 |
| Control 4 | Aluminum Stearate 0.5% | −0.9 | 9 | 0.9 | 62 | 7 |
| Control 5 | Aluminum Stearate 2% | −1.4 | 9 | 1.2 | 80 | 7 |
| Example IV | Example I 0.5% | −2.0 | 9 | 1.1 | 74 | 8.5 |
| Example V | Example I | −2.6 | 13 | 1.3 | 90 | 6 |

-continued

| Example | Additive (%) | Mobility $10^{-10}m^2/Vs$ | Cond. ps/cm | Solid Area Density | Transfer Efficiency | Resolution (lp/mm) |
|---|---|---|---|---|---|---|
| | 2% | | | | | |

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer comprised of thermoplastic resin particles, an optional charge director, and a charge additive or adjuvant comprised of a component of the formulas

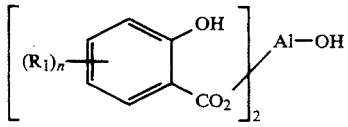

or

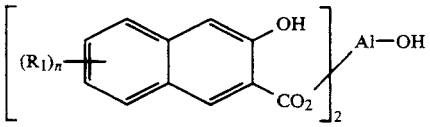

wherein $R_1$ is selected from the group consisting of hydrogen and alkyl, and n is 0 (zero), 1,2,3, or 4.

2. A liquid developer comprised of a liquid component, thermoplastic resin, an ionic or zwitterionic charge director or directors soluble in a nonpolar liquid, and the charge additive, or hydrates thereof of claim 1.

3. A liquid developer comprised of (A) a liquid with a viscosity of from about 0.5 to about 20 centipoise and resistivity equal to or greater than $5\times10^9$; (B) thermoplastic resin particles with an average volume particle diameter of from about 0.1 to about 30 microns; (C) a nonpolar liquid soluble ionic or zwitterionic charge director compound; and (D) the charge additive of claim 1.

4. A developer in accordance with claim 1 wherein alkyl contains from 1 to about 25 carbon atoms.

5. A developer in accordance with claim 1 wherein $R_1$ is hydrogen, methyl, ethyl, propyl, or butyl.

6. A developer in accordance with claim 1 wherein $R_1$ is hydrogen, isopropyl, n-butyl, isobutyl, or tert-butyl.

7. A developer in accordance with claim 1 wherein the charge additive is a hydroxy aluminum complex of the formula as represented by

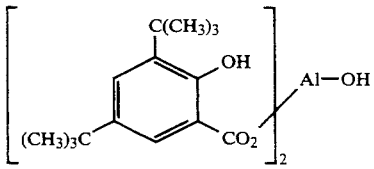

or

-continued

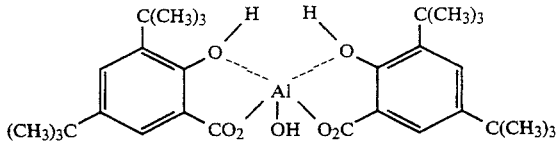

8. A developer in accordance with claim 1 wherein the charge enhancing additive is selected from the group consisting of hydroxy bis[3,5-di-tert-butyl salicylic] aluminate, hydroxy bis[3,5-di-tert-butyl salicylic] aluminate monohydrate, hydroxy bis[3,5-di-tert-butyl salicylic] aluminate dihydrate, hydroxy bis[3,5-di-tert-butyl salicylic] aluminate tri- or tetrahydrate and mixtures thereof.

9. A developer in accordance with claim 1 wherein the resin is a copolymer of ethylene and an $\alpha$, $\beta$ ethylenically unsaturated acid selected from the group consisting of acrylic acid and methacrylic acid; a copolymer of ethylene acrylic or methacrylic acid, alkylester of acrylic or methacrylic acid; or a copolymer of ethylene and methacrylic acid with a melt index at 190° C. of 500.

10. A developer in accordance with claim 1 containing a colorant, pigment, or dye.

11. A developer in accordance with claim 10 wherein the pigment is present in an amount of from about 5 to about 60 percent by weight based on the total weight of the developer solids.

12. A developer in accordance with claim 7 containing a pigment or dye.

13. A developer in accordance with claim 10 wherein the pigment is cyan, magenta, yellow or mixtures thereof.

14. A developer in accordance with claim 10 wherein the pigment is carbon black.

15. A developer in accordance with claim 1 wherein the charge additive is present in an amount of from about 0.1 to about 15 weight percent based on the weight of the developer solids, and there is enabled a negatively charged toner.

16. A developer in accordance with claim 3 wherein component (A) is present in an amount of from about 85 percent to about 99.9 percent by weight, based on the total weight of the liquid developer; the total weight of developer solids is from about 0.1 percent to about 15 percent by weight; and component (C) is present in an amount of from about 0.25 to about 1,500 milligrams/gram of developer solids.

17. A developer in accordance with claim 3 wherein component (D) is present in an amount of from about 0.1 to about 15 percent by weight based on the total weight of developer solids.

18. A developer in accordance with claim 3 further containing a charge adjuvant selected from the group consisting of polyhydroxy compounds which contain at least 2 hydroxy groups, amino alcohols, polybutylene succinimide and metallic soaps.

19. A developer in accordance with claim 1 wherein the liquid for said developer is an aliphatic hydrocarbon.

20. A developer in accordance with claim 6 wherein the liquid is an aliphatic hydrocarbon.

21. A developer in accordance with claim 19 wherein the aliphatic hydrocarbon is a mixture of branched hydrocarbons of from about 12 to about 16 carbon atoms, or a mixture of normal hydrocarbons of from about 10 to about 16 carbon atoms.

22. A developer in accordance with claim 20 wherein the aliphatic hydrocarbon is a mixture of branched hydrocarbons of from about 12 to about 16 carbon atoms.

23. An electrostatic developer in accordance with claim 3 wherein component (C) is an oil-soluble petroleum sulfonate, lecithin, or a quaternary ammonium block copolymer.

24. A developer in accordance with claim 1 wherein the resin is an alkylene polymer, a styrene polymer, an acrylate polymer, a polyester, or mixtures thereof.

25. An imaging method which comprises forming an electrostatic latent image followed by the development thereof with the liquid developer of claim 1.

* * * * *